United States Patent [19]

Yang

[11] Patent Number: 4,699,030

[45] Date of Patent: Oct. 13, 1987

[54] SPINOFF WRENCHES

[76] Inventor: Tai-Her Yang, 5-1 Taipin St., Si-Hu Town, Dzan-Hwa, Taiwan

[21] Appl. No.: 897,155

[22] Filed: Aug. 18, 1986

[51] Int. Cl.[4] ..... B25F 1/04

[52] U.S. Cl. ..... 81/440; 81/437; 81/124.5; 81/125.1; 7/138

[58] Field of Search ..... 81/437, 439, 440, 124.4, 81/124.5, 177.4, 490, 462, 125.1, 121.1, 177.8, 450, 461, DIG. 11, 57.5; 7/138, 167, 168

[56] References Cited

U.S. PATENT DOCUMENTS

| | | | |
|---|---|---|---|
| 966,529 | 8/1910 | Cunningham | 81/57.5 |
| 2,631,623 | 3/1953 | West | 81/440 |
| 2,633,768 | 4/1953 | Saxby | 81/440 |
| 2,933,963 | 4/1960 | Blasdell | 81/440 |
| 2,951,405 | 9/1960 | Engquist | 81/125.1 |
| 3,393,721 | 7/1968 | De Forest | 81/450 |

*Primary Examiner*—Frederick R. Schmidt
*Assistant Examiner*—Bradley I. Vaught
*Attorney, Agent, or Firm*—Leonard Bloom

[57] ABSTRACT

A combination allen/socket wrench is disclosed of the variety having a spinoff design. This wrench has a handle, a pair of outwardly extending parallel support arms each have a respective end is integral with the handle. A bar is mounted between the arms and transverse axis. A plurality of members are rotatably mounted on the bar which extend therefrom radially of the transverse axis of the bar. Each of these members has the end portion thereof formed having a polygonal external configuration of a varying size to one another and each of these members also has a polygonal socket bore formed therein of a varying size to one another whereby a comination allen/socket wrench is provided. A resiliently-biased detent clamp means provides for selectively retaining each of the members against rotational movement. In this fashion during use of the desired wrench portion, the handle may be pivoted on an axis relative to said desired wrench portion.

9 Claims, 5 Drawing Figures

SPINOFF WRENCHES

FILED OF THE INVENTION

The present invention relates to spinoff wrenches, in particular, to a combination allen/socket wrench of the variety having a spinoff design.

BACKGROUND OF THE INVENTION

In traditional allen or socket wrench sets, a series of individual different-size wrench members are provided which constitute the set. During use, one must select the desired wrench member and assemble it with the desired wrench. In that each of these wrench members are loose, they are readily susceptible to being lost. They also require the fabrication of a separate storage case which increases costs and takes up excess space within a tool chest.

Thus it will be appreciated that there remains a need for a wrench having wrench members which are fixed on the wrench and which are adaptable for use, alternatively, as either an allen wrench or as a socket wrench.

SUMMARY OF THE INVENTION

Accordingly, it is the primary objective of the present invention to alleviate the disadvantages and deficiencies of the prior art by providing a spinoff wrench design wherein the wrench members thereof are adaptable for use, alternatively, as an allen wrench or a socket wrench.

In accordance with the teachings of the present invention a wrench is disclosed. Said wrench has a handle having a gripping portion and a forward portion. A pair of outwardly extending parallel support arms, are provided. Each of said arms has a respective end being integral with the forward portion of the handle. A bar is mounted between the arms on a traverse axis. At least one member is provided having a first portion rotatably mounted on the bar, and further having a second portion formed integrally with the first portion and extending therefrom radially of the traverse axis of the bar. The second portion includes a wrench portion. Finally, means is provided for retaining the member against rotation.

In further accordance with the teachings of the present invention, another wrench is disclosed. Said wrench has a handle having a gripping portion and a forward portion. A pair of outwardly extending parallel support arms, are provided. Each of said support arms has a respective end being integral with the forward portion of the handle. Said support arms further define a recessed portion therebetween. A bar is mounted between the arms on a traverse axis. A plurality of members are provided, each having a sleeve portion rotatably mounted on the bar. Each sleeve portion has a first and a second wrench extension diametrically positioned relative to one another about the sleeve portion. Each of said extensions has a first portion mounted on the sleeve for rotational movement therewith. Each of said extensions further has a second portion formed integrally with the first portion and extending therefrom radially of the transverse axis of the bar. Each of said second portions includes a wrench portion. Also means is provided for selectively retaining each of the members against rotational movement on the bar.

In one embodiment, each member is mounted on the bar for independent rotational movement. In a second embodiment, the means for selectively retaining each of the members against rotational movement is a resiliently-biased detent clip means positioned in the recess between the support arms. In a third embodiment, each of the wrench portions is a polygonal shape allen wrench and each wrench portion is of a varying size relative to each other. In an alternative embodiment, each wrench portion has a bore formed therein, whereby a socket wrench is formed. In another alternative embodiment, each of the bores formed in the wrench portions is of a polygonal shape and each bore is of a varying size relative to each other. In still another alternative embodiment, each of the wrench portions has an exterenal polygonal configuration of a varying size relative to one another, whereby a plurality of allen wrenches are provided, and further wherein each wrench portion has a bore of a polygonal shape, each bore being of a varying size relative to one another, whereby a socket wrench is provided. And in still another embodiment, during use of the desired wrench portion, the handle may be pivoted on an axis relative to said desired wrench portion.

In still further accordance with the teachings of the present invention, another wrench is disclosed. This wrench has a handle having a gripping portion and a forward portion. A pair of outwardly extending parallel support arms are provided. Each of said arms has a respective end being integral with the forward portion of the handle. Said support arms define a recessed portion therebetween. A bar is mounted between the arms on a transverse axis. A plurality of members are provided. Each member has a sleeve portion mounted on the bar for rotational movement independent of one another. Each sleeve portion has a first wrench extension and a second wrench extension. Said extensions are diametrically positioned relative to one another about the sleeve portion. Each of said extensions have a first portion mounted on a respective sleeve for rotational movement therewith. Each of said extensions further have a second portion formed integrally with the first portion and extending therefrom radially of the transverse axis of the bar. Each of said second portions includes a wrench portion. Each of said wrench portions have an external polygonal configuration of a varying size relative to one another. Each of said wrench portions further has a polygonal shape bore formed therein said bore being of a varying size relative to one another, whereby a combination allen and socket wrench is formed. A resiliently-biased detent clip means is positioned in the recess between the support arms for selectively retaining each of the members against rotational movement on the bar. Finally, during use of the desired wrench portion, the handle may be pivoted on an axis relative to said desired wrench portion.

Description Of Preferred Embodiment

Figure 1:
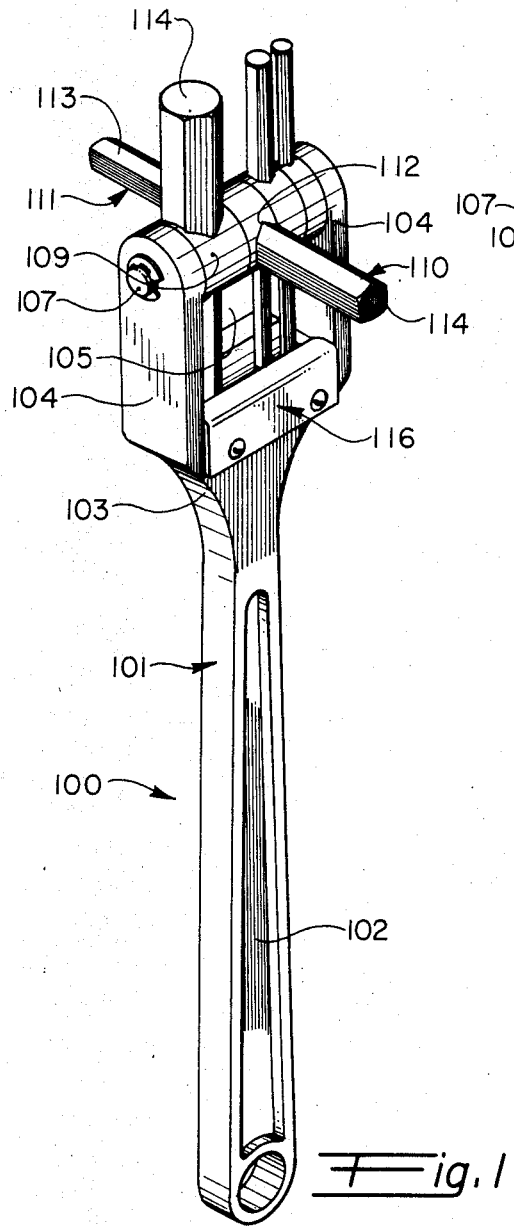
FIG. 1 is a perspective view of an embodiment of the wrench of the present invention.
Figure 2:
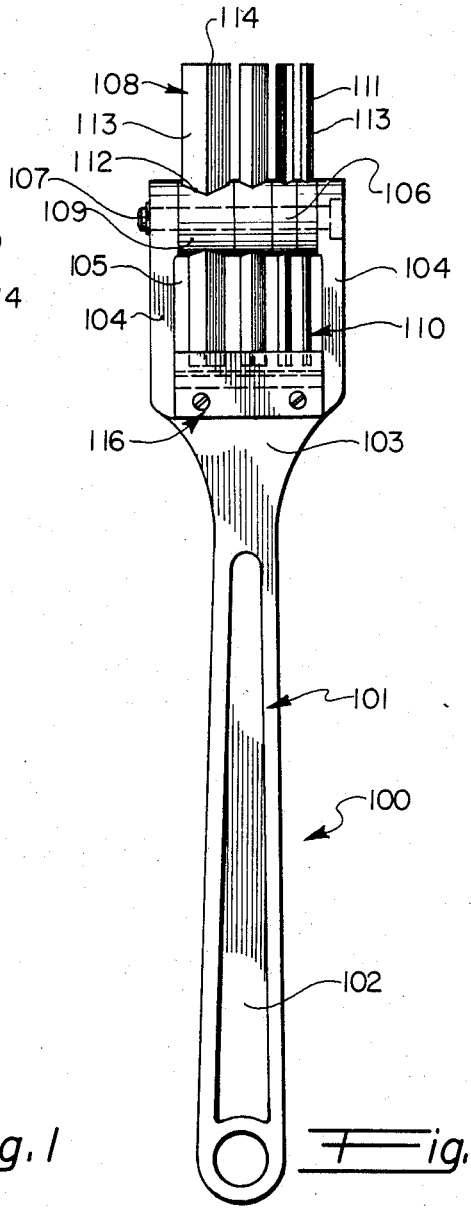
FIG. 2 is an end view of the wrench of FIG. 1.
Figure 3:
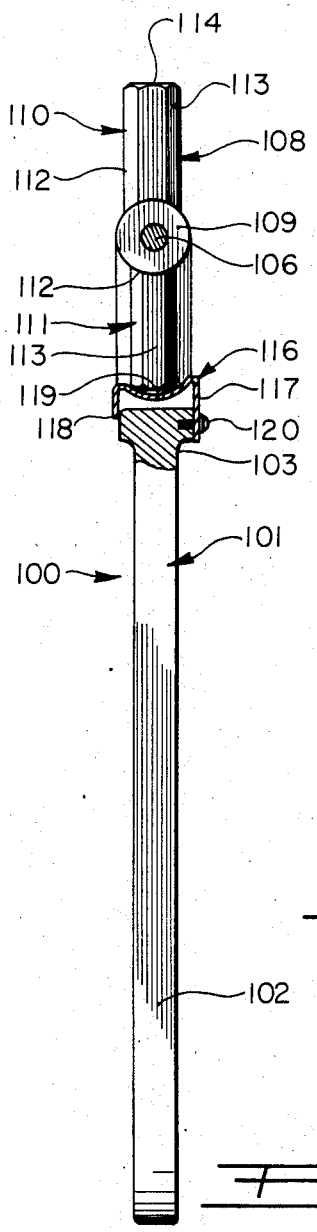
FIG. 3 is a side view taken along lines 3—3 of FIG. 2.

Referring now to the drawings in FIGS. 1, 2 and 3, the wrench 100 has a handle 101. Said handle 101 has a gripping portion 102 and a forward portion 103.

Integral with the forward portion 103 of the handle 101 are a pair of outwardly extending support arms 104. Support arms 104 are so positioned as to be parallel to one another. Positioned thusly, said support arms 104 define a recessed portion 105 therebetween.

Positioned between said support arms 104 and suitably mounted thereto, is a bar 106. Bar 106 is mounted to said arms 104, by suitable means 107, on an axis being traverse thereto.

Figure 4:
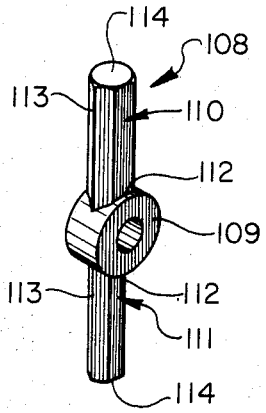
FIG. 4 is a perspective view of one of the members of the present invention removed from the wrench for the sake of clarity.

Carried on the bar 106 are a plurality of members 108. With further reference now to FIG. 4, each of said members 108 are provided with a sleeve portion 109 which is carried on (mounted on) the bar 106 for rotational movement thereon independent of one another. A first wrench extension 110 and a second wrench extension 111 are provided being diametrically positioned relative to one another about the sleeve portion 109. Each of said extensions 110 and 111 have a first portion 112 mounted on a respective sleeve portion 109 for rotational movement therewith. Each of said extensions 110 and 111 further have a second portion 113 formed integrally with the first portion 112 and extending therefrom radially from the transverse axis of the bar 106. Each of said second portions 113 include a wrench portion 114. Each of the wrench portions 114 may be formed having an external polygonal configuration whereby an allen wrench is formed. Each of these wrench portions 114 is further formed having a varying size relative to one another, whereby a series of allen wrenches are formed.

Figure 5:
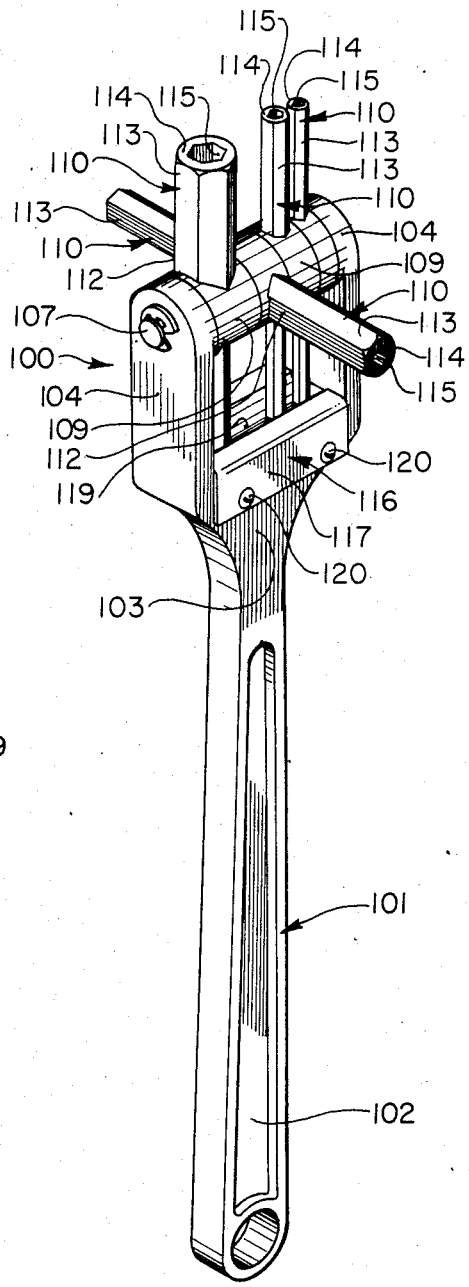
FIG. 5 is a perspective view of a second embodiment of the wrench of the present invention.

With additional reference now to FIG. 5, if desired, each of said wrench portions 114 further has a bore (socket) 115 formed therein, whereby a socket wrench is formed. Preferably this bore (socket) 115 is formed having a polygonal shape. Each of said bores (sockets) 115 is also formed of a varying size relative to one another, whereby a series of socket wrenches are formed. Formed thusly, each of the wrench portions 114 is a combination allen and socket wrench.

With special reference now to FIG. 3, a means 116 is provided for selectively retaining the members 108 against rotational movement on the bar 106. Said means 116 is, preferably a resiliently-biased detent clip means. Said detent clip means 116 has forward and rearward raised retaining portions, 117 and 118 respectively, and a central depressed area 119.

Means 116 may be secured in place by screws 120 or any other suitable means. The members 108 not being used are rotated until the wrench portions 114 thereof engage the forward retaining portion 117. The continued rotational application of force on the member 108 caused the wrench portion 114 to overcome the biasing force of the clip means 116 forcing the forward portion 117 thereof downwardly towards the handle 101 and permitting the said wrench portion 114 to pass thereover. When said wrench portion 114 enters the area over the depressed area 119 the resilient biasing force of the clip means 116 causes the forward portion 117 to return to its original raised position. In this manner, the wrench portion 114 is retained between the forward and rearward raised retaining portions 117 and 118 respectively, in the central depressed area 119 against further rotational movement on the bar 106.

In a similar fashion by applying force to members 108 retained in the depressed area 119, the biasing action of the forward portion 117 may be overcome and the desired wrench portion 114 released therefrom. When released thusly, and during use, of said desired wrench portion 114, the handle 101 may be pivoted on an axis relative to said desired wrench portion 114.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A wrench comprising:

a handle having a gripping portion and a forward portion;

a pair of outwardly extending parallel support arms, each of said arms having a respective end being integral with the forward portion of the handle;

a bar mounted between the arms on a transverse axis;

at least one member having a first portion rotatably mounted on the bar, and further having a second portion formed integrally with the first portion and extending therefrom radially of the transverse axis of the bar, the second portion including a wrench portion;

each wrench portion having an external polygonal configuration, whereby an allen wrench is provided, and each wrench portion further having a bore of a polygonal shape, whereby a socket wrench is provided; and means for retaining the member against rotation.

2. A wrench comprising:

a handle having a gripping portion and a forward portion;

a pair of outwardly extending parallel support arms, each of said support arms having a respective end being integral with the forward portion of the handle, said support arms defining a recessed portion therebetween;

a bar mounted between the arms on a transverse axis;

a plurality of members each having a sleeve portion rotatably mounted on the bar, each sleeve portion having a first and a second wrench extension diametrically positioned relative to one another about the sleeve portion, each of said extensions having a first portion mounted on the sleeve for rotational movement therewith and each of said extensions further having a second portion formed integrally with the first portion and extending therefrom radially of the transverse axis of the bar, each of said second portions including a wrench portion;

each of the wrench portions having an external polygonal configuration of a varying size relative to one another, whereby a plurality of allen wrenches are provided, and each wrench portion further having a bore of a polygonal shape, each bore being of a varying size relative to one another, whereby a socket wrench is provided, and means for selectively retaining each of the members against rotational movement on the bar.

3. The wrench of claim 2, wherein each member is mounted on the bar for independent rotational movement.

4. The wrench of claim 2, wherein the means for selectively retaining each of the members against rotational movement is a resiliently-biased detent clip means positioned in the recess between the support arms.

5. The wrench of claim 2, wherein each of the wrench portions is a polygonal shape allen wrench and further wherein each wrench portion is of a varying size relative to each other.

6. The wrench of claim 2, wherein each wrench portion has a bore formed therein, whereby a socket wrench is formed.

7. The wrench of claim 6, wherein each of the bores formed in the wrench portions is of a polygonal shape and further wherein each bore is of a varying size relative to each other.

8. The wrench of claim 2, wherein during use of the desired wrench portion the handle may be pivoted on an axis relative to said desired wrench portion.

9. A wrench comprising:

a handle having a gripping portion and a forward portion;

a pair of outwardly extending parallel support arms, each of said arms having a respective end being integral with the forward portion of the handle, said support arms defining a recessed portion therebetween;

a bar mounted between the arms on a transverse axis;

a plurality of members, each having a sleeve portion mounted on the bar for rotational movement independent of one another, each member further having a first wrench extension and a second wrench extension, said extensions being diametrically positioned relative to one another about the sleeve portion, each of said extensions having a first portion mounted on a respective sleeve for rotational movement therewith, and each of said extensions further having a second portion formed integrally with the first portion and extending therefrom radially of the transverse axis of the bar, each of said second portions including a wrench portion;

each of said wrench portions having an external polygonal configuration of a varying size relative to one another and each of said wrench portions further having a polygonal shape bore formed therein of a varying size relative to one another whereby a combination allen and socket wrench is formed;

a resiliently-biased detent clip means, positioned in the recess between the support arms for selectively retaining each of the members against rotational movement on the bar; and wherein during use of he desired wrench portion, the handle may be pivoted on an axis relative to said desired wrench portion.

* * * * *